US012214413B2

(12) United States Patent
Trautz et al.

(10) Patent No.: US 12,214,413 B2
(45) Date of Patent: Feb. 4, 2025

(54) PROCESSING UNIT AND PROCESSING MACHINE FOR PROCESSING A WORKPIECE WALL OF A WORKPIECE, AND METHOD FOR PRODUCING SUCH A PROCESSING UNIT

(71) Applicant: FELSS Systems GmbH, Koenigsbach-Stein (DE)

(72) Inventors: Udo Trautz, Bretten (DE); Alexander Muthny, Tiefenbronn-Lehningen (DE); Matthias Kluge, Oelbronn-Duerrn (DE)

(73) Assignee: FELSS Systems GmbH, Koenigsbach-Stein (DE)

( * ) Notice: Subject to any disclaimer, the term of this patent is extended or adjusted under 35 U.S.C. 154(b) by 598 days.

(21) Appl. No.: 17/602,914

(22) PCT Filed: Apr. 28, 2020

(86) PCT No.: PCT/EP2020/061676

§ 371 (c)(1),
(2) Date: Oct. 11, 2021

(87) PCT Pub. No.: WO2020/229156

PCT Pub. Date: Nov. 19, 2020

(65) Prior Publication Data

US 2022/0184688 A1 Jun. 16, 2022

(30) Foreign Application Priority Data

May 14, 2019 (DE) ..... 10 2019 112 547.2

(51) Int. Cl.
*B21J 5/12* (2006.01)

(52) U.S. Cl.
CPC ..... *B21J 5/12* (2013.01)

(58) Field of Classification Search
CPC ..... B21J 5/12; B21J 5/02; B21J 5/025; B21J 13/00; B21J 13/02; B21J 13/03; B21K 1/56

(Continued)

(56) References Cited

U.S. PATENT DOCUMENTS 3,155,229 A 11/1964 Lacksinger
5,463,812 A 11/1995 Aschenbruck et al.

(Continued)

FOREIGN PATENT DOCUMENTS

CN 2860659 Y 1/2007
CN 201855937 U 6/2011

(Continued)

OTHER PUBLICATIONS

Machine translation of EP 0734803 A2 (Year: 1996).*

(Continued)

*Primary Examiner* — Jimmy T Nguyen
*Assistant Examiner* — Teresa A Guthrie
(74) *Attorney, Agent, or Firm* — Collard & Roe, P.C.

(57) ABSTRACT

A processing unit for processing a workpiece wall of a workpiece with a forward stroke carried out by the processing unit in a forward stroke direction of the processing unit towards the workpiece, and with a backward stroke carried out by the processing unit in a backward stroke direction of the processing unit away from the workpiece, wherein the workpiece and the processing unit move relative to each other along a working axis of the processing unit. A processing machine for processing a workpiece wall of a workpiece contains the processing unit.

12 Claims, 2 Drawing Sheets

Figure 1A:
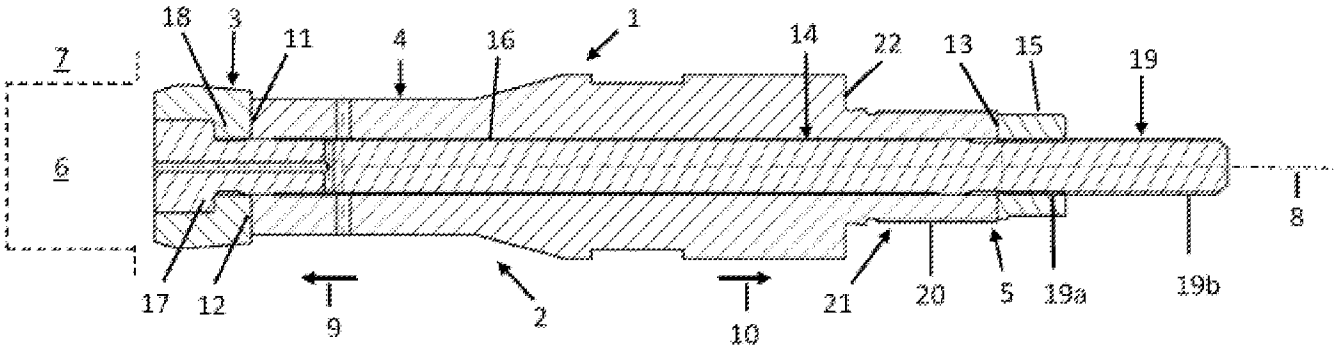

(58) Field of Classification Search
USPC ..... 72/352
See application file for complete search history.

(56) References Cited

U.S. PATENT DOCUMENTS

| | | | |
|---|---|---|---|
| 8,490,529 | B2 | 7/2013 | Meissner et al. |
| 8,899,468 | B2 | 12/2014 | Miyahara et al. |
| 9,381,632 | B2 * | 7/2016 | Hohmann ..... B23P 19/067 |

FOREIGN PATENT DOCUMENTS

| | | | |
|---|---|---|---|
| CN | 103068500 | A | 4/2013 |
| CN | 103495655 | A | 1/2014 |
| CN | 104400536 | A | 3/2015 |
| CN | 104690153 | A | 6/2015 |
| DE | 279427 | A1 | 6/1990 |
| DE | 4238922 | A1 | 5/1994 |
| DE | 29705575 | U1 | 4/1998 |
| DE | 10312412 | B3 | 8/2004 |
| DE | 202009005552 | U1 | 8/2009 |
| EP | 0366047 | A2 * | 5/1990 |
| EP | 0734803 | A2 | 10/1996 |
| EP | 2181839 | A2 | 5/2010 |
| JP | S53-72886 | U | 6/1978 |
| JP | H0890448 | A | 4/1996 |
| WO | 01/87525 | A1 | 11/2001 |
| WO | 2005/042195 | A1 | 5/2005 |
| WO | 2008/150219 | A1 | 12/2008 |
| WO | 2014/127391 | A1 | 8/2014 |
| WO | 2013/027474 | A1 | 3/2015 |
| WO | 2015/054708 | A1 | 4/2015 |

OTHER PUBLICATIONS

Chinese Office Action in Chinese Patent Application No. 202080035492.1, issued Mar. 6, 2023 with English translation of relevant portions.
International Preliminary Report on Patentability mailed Nov. 18, 2021 issued in PCT/EP2020/061676 (with English translation).
International Search report dated Aug. 3, 2020 issued in PCT/EP2020/061676 (with English translation).
German Office Action dated Feb. 3, 2020 issued in the corresponding German Application DE 10 2019 112 547.2 (with English translation of relevant parts).
Indian Office Action mailed Sep. 14, 2022 issued in corresponding Indian Application Serial No. 202137054750 (with English translation).
Japanese Office Action in Japanese Patent Application No. 2021-562009, issued Apr. 26, 2023 with an English translation thereof.
Korean Office Action issued in Patent Application No. 10-2021-7039991, Dated Jun. 28, 2024 (with English translation).

* cited by examiner

PROCESSING UNIT AND PROCESSING MACHINE FOR PROCESSING A WORKPIECE WALL OF A WORKPIECE, AND METHOD FOR PRODUCING SUCH A PROCESSING UNIT

CROSS REFERENCE TO RELATED APPLICATIONS

This application is the National Stage of PCT/EP2020/061676 filed on Apr. 28, 2020, which claims priority under 35 U.S.C. § 119 of German Application No. 10 2019 112 547. 2 filed on May 14, 2019, the disclosures of which are incorporated by reference. The international application under PCT article 21(2) was not published in English.

BACKGROUND OF THE INVENTION

The invention relates to a processing unit for processing a workpiece wall of a workpiece, with a forward stroke carried out by the processing unit in a forward stroke direction of the processing unit towards the workpiece, and with a backward stroke carried out by the processing unit in a backward stroke direction of the processing unit away from the workpiece, wherein the workpiece and the processing unit move relative to each other along a working axis of the processing unit, having a machine tool for processing the workpiece wall, wherein the machine tool is in contact with the workpiece during the forward stroke and during the backward stroke of the processing unit, having a tool support which is provided for the machine tool and which has a forward stroke bearing surface on the support pointing in the forward stroke direction and a backward stroke bearing surface on the support which is spaced from the forward stroke bearing surface on the support along the working axis of the processing unit and which points in the backward stroke direction, wherein the machine tool is arranged in front of the forward stroke bearing surface on the support in the forward stroke direction, and wherein the machine tool is supported on the forward stroke bearing surface on the support in the opposite direction of the forward stroke direction during the forward stroke of the processing unit, and is supported on the backward stroke bearing surface on the support in the opposite direction of the backward stroke direction during the backward stroke of the processing unit, and having a clamping device by means of which the machine tool can be clamped along the working axis against the forward stroke bearing surface on the support and against the backward stroke bearing surface on the support.

The invention also relates to a processing machine for processing a workpiece wall of a workpiece, having a processing unit and having a processing drive by means of which the workpiece and the processing unit can be moved relative to each other along a working axis of the processing unit with a forward stroke executed by the processing unit in a forward stroke direction of the processing unit towards the workpiece, and with a backward stroke executed by the processing unit in a backward stroke direction of the processing unit away from the workpiece.

Finally, the invention relates to a method for producing a processing unit of the type mentioned at the outset.

Processing units and processing machines of the aforementioned type are used, for example, in metal processing.

Among other things, they are used for profiling the walls of holes in metallic components. A frequent application is the creation of a toothing on the wall of a blind hole provided on the component in question. During the processing, the processing unit executes a forward stroke directed along a working axis of the processing unit towards the workpiece relative to the workpiece being processed, and executes a backward stroke following the forward stroke, in the opposite direction of the forward stroke, in a backward stroke direction away from the workpiece. To generate the relative movement of the processing unit and workpiece, the processing unit alone, or the workpiece alone, or both the processing unit and the workpiece, can be moved along the working axis. The processing procedure may be performed for the purpose of separating and/or forming.

The machine tool arranged on the tool support of the processing unit is in contact with the workpiece during both the forward stroke and the backward stroke. As a result, forces caused by the processing procedure act on the machine tool in alternating directions along the working axis. For the processing to achieve a high-quality result, it must be ensured that the position of the machine tool on the tool support does not change during a processing, regardless of the processing forces acting on the mas chine tool.

In the case of the generic prior art disclosed in DE 20 2009 005 552 U1, this is achieved in two ways.

Common to both variants of the prior art is a tool body of a processing unit that functions as a tool support and that is provided with a cylindrical fastening region running along the working axis of the processing unit at the end positioned in the forward stroke direction of the processing unit. The cylindrical fastening region has a reduced cross section compared to the rest of the tool body adjoining it in the backward stroke direction, thereby forming a shoulder extending transverse to the working axis.

In the case of a first embodiment of the prior art, the cylindrical fastening region has a smooth-walled axial section which joins with the rest of the tool body. In the previously known processing unit, the smooth-walled axial section is followed in the forward stroke direction by an axial thread section of the cylindrical fastening region, provided with an external thread. The machine tool is designed like a sleeve, and has an axial length which corresponds approximately to the length of the smooth-walled axial section of the cylindrical fastening region provided on the tool body. To fix it to the tool body, the machine tool is pushed onto the smooth-walled axial section of the cylindrical fastening region. A locking nut is then screwed onto the threaded section of the cylindrical fastening region and, by tightening the locking nut, the machine tool is clamped between the locking nut on the one hand and the shoulder formed by the rest of the tool body on the other. Via the locking nut and the shoulder on the remaining tool body, the machine tool is positively secured during a processing both against undesired displacement in the forward stroke direction and against undesired displacement in the backward stroke direction. Because of the positive locking on both sides, the machine tool maintains its target position on the tool body of the previously known processing unit even when significant forces caused by the processing act on the machine tool along the working axis of the processing unit. However, the use of this type of previously known processing unit is ruled out in applications in which the thread section of the cylindrical fastening region provided on the tool body, which protrudes in relation to the machine tool in the forward stroke direction, and the locking nut sitting on the thread section, would be a hindrance—for example, due to the spatial conditions on the workpiece being processed.

The second type of processing unit of the prior art has a wider range of application in this respect, and is limited in the forward stroke direction by the smooth-walled axial section of the cylindrical fastening region of the tool body and by the machine tool seated on it, and accordingly has no threaded section with a locking nut which protrudes with respect to the machine tool in the forward stroke direction. However, the possible uses of the second type of previously known processing unit are limited insofar as the connection between the machine tool and the smooth-walled axial section of the cylindrical fastening region provided on the tool body is less load-bearing than the positive connection in the case of the first type of prior art. The reason for the reduced load-bearing capacity is the fact that the machine tool, which limits the processing unit of the second type in the forward stroke direction, is fixed on the smooth-walled axial section of the cylindrical fastening region of the tool body by material bonding, in particular by soldering or gluing.

SUMMARY OF THE INVENTION

The objective of the present invention is to provide a processing unit and a processing machine having a comprehensive field of application, as well as a method for producing a processing unit that can be used comprehensively.

According to the invention, this object is achieved a processing unit for processing a workpiece wall of a workpiece, with relative movement of the workpiece and the processing unit along a working axis of the processing unit, with a forward stroke carried out by the processing unit in a forward stroke direction of the processing unit towards the workpiece, and with a backward stroke carried out by the processing unit in a backward stroke direction of the processing unit away from the workpiece, the processing unit comprising a machine tool for processing the workpiece wall, and a tool support provided for the machine tool, wherein the machine tool is in contact with the workpiece during the forward stroke and during the backward stroke of the processing unit.

In the case of the invention, the machine tool is positively supported on the tool support along the working axis of the processing unit both in the forward stroke direction and in the backward stroke direction, without the need for a fastening means in front of the machine tool in the forward stroke direction. Consequently, the processing unit according to the invention is suitable both for applications in which a fastening means arranged in front of the machine tool in the forward stroke direction would be a hindrance, and for applications in which significant forces caused by the processing procedure act on the machine tool along the working axis of the processing unit, and must be transferred from the machine tool into the tool support. The processing unit according to the invention is preferably limited in the forward stroke direction by the machine tool. The processing machine equipped with the processing unit according to the invention is designed in particular as an axial forming machine.

During a forward stroke of the processing unit, the machine tool is positively supported on the face of the tool support oriented in the forward stroke direction, on the forward stroke bearing surface thereof. During a backward stroke following a forward stroke, the machine tool is positively supported on the backward stroke bearing surface of the tool support, which is spaced apart from the forward stroke bearing surface in the backward stroke direction. The adjusting element of the clamping device according to the invention bears on the backward stroke bearing surface of the tool support in the forward stroke direction. The adjusting element bears on the backward stroke bearing surface of the tool support by means of the tension element of the clamping device according to the invention, which is connected to the machine tool and which, also during a backward stroke of the processing unit, pulls the adjusting element of the clamping device against the backward stroke bearing surface, and also pulls the machine tool against the forward stroke bearing surface.

In order to prevent the machine tool from lifting off the forward stroke bearing surface in the opposite direction of the forward stroke direction during a backward stroke of the processing unit according to the invention, due to the forces acting on the machine tool during the backward stroke, and thereby undesirably changing its position on the tool support along the working axis of the processing unit, the tension element of the clamping device according to the invention is sufficiently strongly preloaded along the working axis of the processing unit.

The preload of the tension element of the clamping device according to the invention along the working axis of the processing unit is generated by means of a tensioning device in the context of the method according to the invention for producing the processing unit according to the invention. The processing unit is supported in the backward stroke direction with the tool support on a tensioning device support of the tensioning device. By means of a tension member of the tensioning device, which is connected to the tension element of the clamping device of the processing unit, the tension element is then loaded with tension in the backward stroke direction. For this purpose, the force is applied to the tension member of the tensioning device in the backward stroke direction. The tension element of the clamping device of the processing unit is connected to the machine tool on the side remote from the tension member of the tensioning device, and is supported in the backward stroke direction via the machine tool on the forward stroke bearing surface of the tool support.

When the tension element of the clamping device is loaded with tension, the adjusting element of the clamping device seated on the tension element and in threaded engagement with the tension element is moved along the working axis into a target position by rotary actuation. The target position of the adjusting element of the clamping device is preferably selected in such a manner that, immediately upon the removal of the tensile load on the tension element of the clamping device exerted by the tension member of the tensioning device, the desired preload on the tension element is achieved between the adjusting element of the clamping device, bearing on the backward stroke bearing surface, and the machine tool, bearing on the forward stroke bearing surface. According to the invention, a readjustment can also be contemplated, by a rotary actuation of the adjusting element following the separation of the tension element of the clamping device from the tension member of the tensioning device, in the event that the target preload has not yet been achieved on the tension member immediately upon its release by the tensioning device.

The rotary actuation of the adjusting element during the tensile loading of the tension element of the clamping device preferably takes place when the adjusting element is spaced apart from the backward stroke bearing surface of the tool support. If the adjusting element is spaced apart from the backward stroke bearing surface during the rotary actuation, friction is avoided between the adjusting element and the tool support, which would otherwise occur and which could impair the accuracy of the positioning of the adjusting element. Since no friction has to be overcome between the adjusting element and the tool support, only a relatively low tightening torque is required for the rotary actuation of the adjusting element.

After the adjusting element has been appropriately positioned on the tension element of the clamping device, the tensile load on the tension element is released, and the processing unit can be separated from the tensioning device. Due to the action of the previously generated preload of the tension element, the clamping element of the clamping device bears on the backward stroke bearing surface of the tool support. Also due to the action of the previously generated preload of the tension element, the machine tool is drawn towards the forward stroke bearing surface.

According to one embodiment, the tension element of the clamping device of the processing unit is preloaded by means of a hydraulic tensioning device. The hydraulic tensile loading of the tension element makes it possible to subject the tension element to a precise tension load. This is of particular importance because the preload of the tension element should be set to a maximum value, on the one hand, but at the same time the material-dependent tensile strength of the tension element must not be exceeded. It is expedient to adjust the preload on the tension element to a maximum value, due to the reason that, for a backward stroke of the processing unit, the machine tool is better secured against lifting off the forward stroke bearing surface of the tool support in proportion to the amount of force with which the machine tool is pulled by the tension element of the clamping device against the forward stroke bearing surface on the tool support. If the preload of the tension element can be adjusted precisely, the tensile strength of the tension element can be utilized to the maximum.

In the case of some embodiments of the invention, the tension element is preloaded with tension along the working axis of the processing unit according to the invention by means of rotary actuation of the adjusting element of the clamping device or by means of a tensioning device. Furthermore, an inventive design is conceivable in which the tension element of the clamping device is preloaded both by rotary actuation of the adjusting element and by means of a tensioning device.

In order to connect the tension element of the clamping device to the tension member of the tensioning device, the tension element is provided with a corresponding coupling device in a further development of the invention. A coupling thread provided on the tension element is preferred as the coupling device, by means of which a detachable threaded connection with the tension member of the tensioning device can be established.

In a further preferred embodiment of the processing unit according to the invention, the tension element of the clamping device is designed as a pull rod.

According to another embodiment, the tool support of the processing unit according to the invention is preferably designed as a hollow body which is provided with a receptacle extending along the working axis of the processing unit for the tension element, in particular the pull rod, of the clamping device.

In order to ensure a permanently effective support of the machine tool on the forward stroke bearing surface of the tool support, in a further development of the processing unit according to the invention, a form-fitting connection is provided between the machine tool and the tension element of the clamping device, via which the preload of the tension element is converted into a load applied by the machine tool onto the forward stroke bearing surface of the tool support. To produce the form fit, the machine tool and the tension element of the clamping device have a corresponding component geometry. According to the invention, mutually assigned surfaces on the machine tool and on the tension element, which run essentially perpendicular to the working axis of the processing unit according to the invention, are preferred, as are a conical shape on one component and a corresponding counter-conical shape on the other of the components which must be positively connected.

In particular, an adjusting element designed as an adjusting nut can be in threaded engagement with the tension element of the clamping device. For cases in which the preload of the tension element is at least partially generated by rotary actuation of the adjusting element, the adjusting nut is provided with an outer contour which in turn is adapted to an actuating tool.

In the case of a preferred embodiment of the invention, the machine tool limits the processing unit in the forward stroke direction. Additionally or alternatively, it is provided that the tool support of the processing unit according to the invention is limited in the backward stroke direction by the backward stroke bearing surface. If the backward stroke bearing surface forms the limit of the tool support on the backward stroke side, a sufficiently large load area is available on the tool support for the adjusting element of the clamping device. In addition, the adjusting element assigned to the backward stroke bearing surface is easily accessible, in particular for setting the preload of the tension element of the clamping device.

In a further preferred embodiment of the invention, the unit comprising the machine tool, the tool support, and the clamping device is not connected directly, but rather via a coupling element, to a processing drive. The processing drive is used to generate the relative movement of a workpiece being processed and the processing unit according to the invention. The coupling element between the unit comprising the machine tool, the tool support, and the clamping device on the one hand, and the processing drive on the other hand, can serve as an adapter, the design of which varies, for example on the drive side, depending on the application and which then makes it possible to connect one and the same unit comprising the machine tool, the tool support, and the clamping device in an application-specific manner to a processing drive.

In order for the connection between the unit comprising the machine tool, the tool support, and the clamping device on the one hand, and the coupling element on the other hand, to be able to withstand also high processing forces, a form-fitting connection between the tool support and the coupling element is provided in a further preferred embodiment of the processing unit according to the invention. In particular, the tool support and the coupling element are screwed together.

In a preferred screw connection according to the invention between the tool support and the coupling element, the production of the screw connection between the tool support and the coupling element of the processing unit according to the invention causes a tensile load effective in the backward stroke direction on a threaded projection of the tool support, and accordingly a tensile load and preload of the tension element of the clamping device. The threaded projection of the tool support is screwed into an internal thread on the coupling element in the manner of a screw bolt. The protrusion of the tool support relative to the threaded projection, transverse to the working axis of the processing unit, contacts a stop face on the coupling element via its support-side stop face, like a screw head. A tightening of the tool support, associated with a rotational movement of the tool support supported in the axial direction on the coupling element relative to the coupling element, consequently leads to an elongation of the threaded projection on the support. Since the threaded projection on the support forms the backward stroke bearing surface on the support for the adjusting element of the clamping device, on an end face pointing in the backward stroke direction, the elongation of the threaded projection on the support causes via the adjusting element supported on the end face of the threaded projection a tensile load and preload of the tension element of the clamping device connected to the adjusting element.

BRIEF DESCRIPTION OF THE DRAWING FIGURES

Figure 1B:
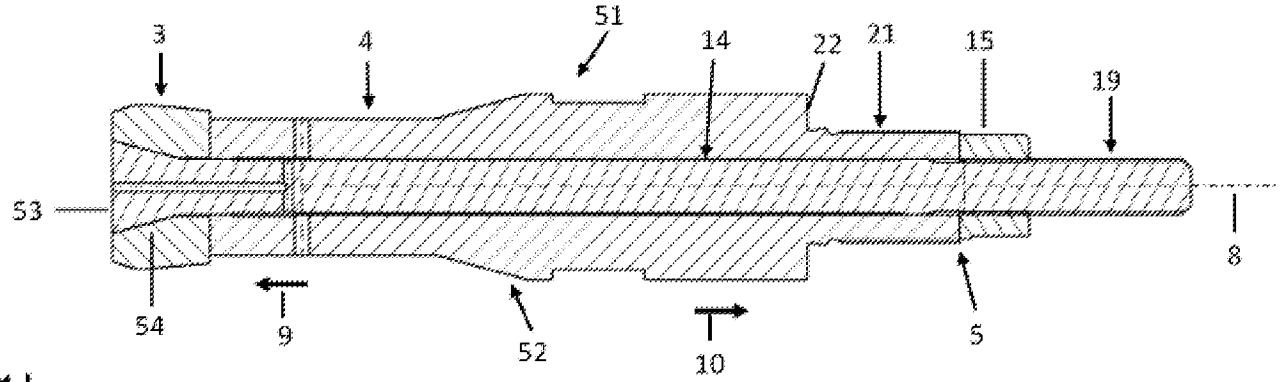
Figure 2:
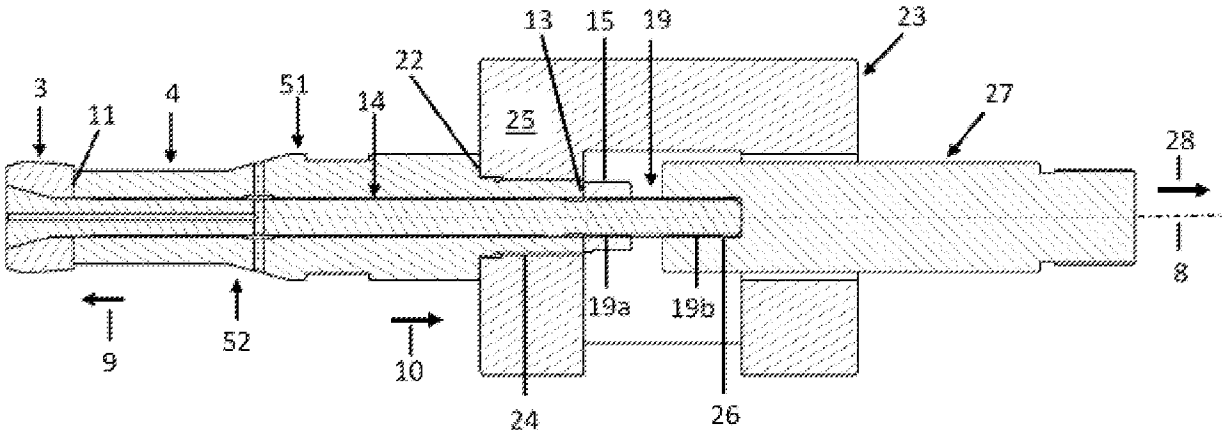
Figure 3:
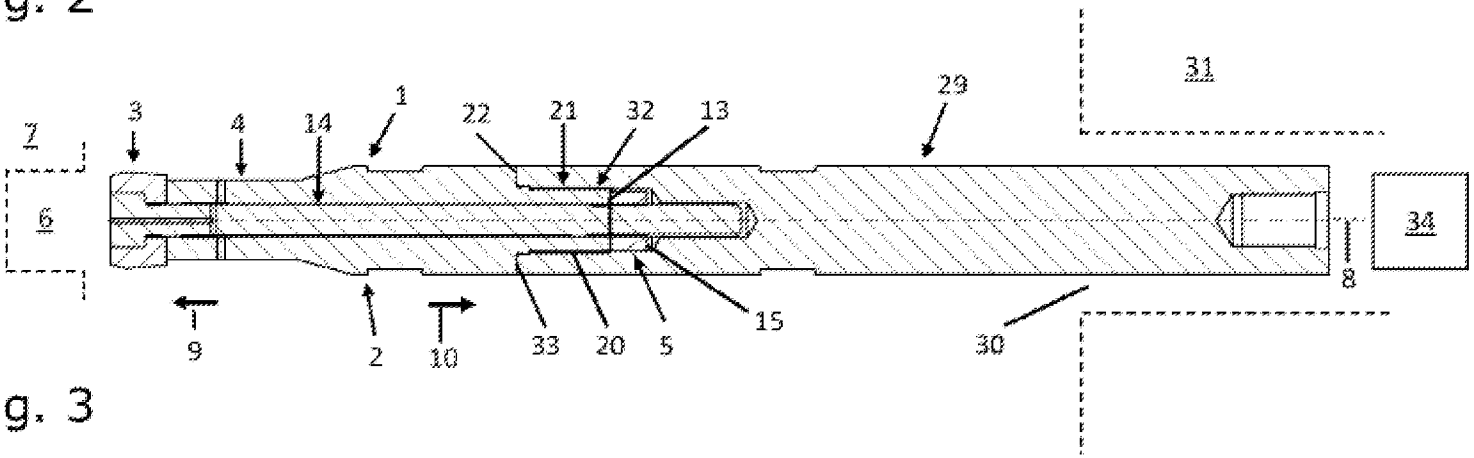

In the following, the invention is explained in more detail using exemplary schematic illustrations. In the drawings:

FIG. 1*a*: is a sub-unit of a first embodiment of a processing for producing a toothing on a wall of a blind hole on a metallic workpiece, FIG. 1*b*: is a sub-unit of a second embodiment of a processing unit for producing a toothing on a wall of a blind hole on a metallic workpiece, FIG. 2: is the sub-unit according to FIG. 1*b* on a tensioning device when a preload is generated on a pull rod of the sub-unit, and FIG. 3: is the first embodiment of the processing unit, comprising the sub-unit according to FIG. 1*a*.

DETAILED DESCRIPTION OF THE INVENTION

In FIG. 1*a*, as part of a processing unit 1 a sub-unit 2 is shown, which in turn comprises a machine tool 3, a tool support 4, and a clamping device 5.

The machine tool 3 is a conventional forming die made of hard metal, which is used to produce a toothing on a wall of a blind hole 6 in a metallic workpiece 7 indicated by dashed lines in FIG. 1*a*. For this purpose, the machine tool 3 is provided with a shaping toothing in the usual way. The teeth of the shaping toothing on the machine tool 3 run 1*o* along a working axis 8 of the processing unit 1.

To produce the toothing on the wall of the blind hole 6, the processing unit 1 and the workpiece 7 are moved relative to each other along the working axis 8. A forward stroke carried out by the processing unit 1 in a forward stroke direction (arrow 9) towards the workpiece 7 is followed by a backward stroke of the processing unit 1 directed away from the workpiece 7 in a backward stroke direction 10.

During both the forward stroke and the backward stroke of the processing unit 1, the machine tool 3 is in contact with the wall of the workpiece 7. The forces acting on the machine tool 3 along the working axis 8 as a result of the processing are transferred to the tool support 4.

During the forward stroke of the processing unit 1, the machine tool 3 engaging in the wall of the blind hole 6 is supported on a forward stroke bearing surface 11 on the support opposite the forward stroke direction 9. In the same manner as a counter surface 12 of the machine tool 3 situated opposite the forward stroke bearing surface 11 of the tool support 4, the forward stroke bearing surface 11 on the support extends essentially perpendicular to the working axis 8.

During the backward stroke of the processing unit 1 in the backward stroke direction 10, the machine tool 3 in contact with the wall of the blind hole 6 is compelled to lift off the forward stroke bearing surface 11 of the tool support 4 along the working axis 8. This is prevented by a support of the machine tool 3, which acts in the opposite direction of the backward stroke direction 10, on a backward stroke bearing surface 13 on the support. The backward stroke bearing surface 13 on the support is spaced apart from the forward stroke bearing surface 11 on the support in the backward stroke direction 10, and faces away from the forward stroke bearing surface 11 on the support.

The support of the machine tool 3 on the backward stroke bearing surface 13 of the tool support 4 is not implemented directly, but rather via a pull rod 14 which is provided as a tension element and which is structurally separate from the tool support 4, and also via an adjusting element of the clamping device 5 that sits on the pull rod 14 and is designed as an adjusting nut 15.

The pull rod 14 of the clamping device 5 extends in a receptacle 16 of the tool support 4, which is designed as a hollow body, along the working axis 8. In the forward stroke direction 9, the pull rod 14 ends flush with the machine tool 3. Consequently, in the example shown, the machine tool 3, together with the end face of the pull rod 14 in the forward stroke direction 9, delimits the processing unit 1 in the forward stroke direction 9. Alternatively, the end face of the pull rod 14 in the forward stroke direction 9 can be set back opposite to the forward stroke direction 9 in relation to the end face of the machine tool 3 in the forward stroke direction 9. In both cases, the wall of the blind hole 6 can be formed over its entire axial length by means of the machine tool 3.

On the side positioned in the forward stroke direction 9, the pull rod 14 is positively connected to the machine tool 3. For this purpose, the cross section of the pull rod 14 expands to form a shoulder 17 of the pull rod running perpendicular to the working axis 8. The shoulder 17 on the pull rod 14 works together with a shoulder 18 on the tool, which also runs perpendicular to the working axis 8, in order to produce the form fit between the pull rod 14 and the machine tool 3.

The end of the pull rod 14 pointing in the backward stroke direction 10 is provided with an external pull rod thread 19. The external thread 19 on the pull rod forms an adjusting thread 19*a* with which the adjusting nut 15 of the clamping device 5 is in threaded engagement. By rotating the adjusting nut 15 about the working axis 8, the adjusting nut 15 can be displaced along the pull rod 14 either in the forward stroke direction 9 or in the backward stroke direction 10. Due to the self-locking design of the adjusting thread 19*a*, and the internal thread on the adjusting nut 15 that meshes with it, the adjusting nut 15 maintains a set position along the working axis 8 even when the adjusting nut 15 is subjected to a force along the working axis 8. The adjusting nut 15 is provided with an outer contour. With the help of a tool adapted to the outer contour of the adjusting nut 15, a rotary actuation of the adjusting nut 15 about the working axis 8 is possible.

An outer support thread 20 is provided on the end of the tool support 4 positioned in the backward stroke direction 10 on a bolt-like threaded projection 21 of the tool support 4. The end face of the threaded projection 21 pointing in the backward stroke direction 10 forms the backward stroke bearing surface 13 of the tool support 4. The threaded projection 21 has a reduced cross section compared to the part of the tool support 4 adjoining it in the forward stroke direction 9. As a result, an annular support surface 22, which is concentric with the threaded projection 21 and extends in the transverse direction of the working axis 8, is formed on the tool support 4.

A sub-unit 52 of a processing unit 51 shown in FIG. 1*b* differs from the sub-unit 2 according to FIG. 1*a* only by the constructive implementation of the form fit between the pull rod 14 of the clamping device 5 and the machine tool 3.

In the case of the sub-unit 52, instead of the cooperating shoulder 17 on the pull rod and the shoulder 18 of the sub-unit 2 on the tool, a pull rod cone 53 and a tool mating cone 54 are provided as mutually cooperating interlocking elements.

So that the machine tool 3 does not lift off the forward stroke bearing surface 11 on the support during the backward stroke of the processing unit 1, 51, executed relative to the workpiece 7, the pull rod 14 is preloaded with tension along the working axis 8. Due to the preload, the pull rod 14 pulls the machine tool 3 against the forward stroke bearing surface 11 on the support, and pulls the adjusting nut 15 against the backward stroke bearing surface 13 on the support.

A hydraulic tensioning device 23, as shown schematically in FIG. 2, is used to generate the preload of the pull rod 14 along the working axis 8.

The processes for generating the preload of the pull rod 14 of the processing unit 51 and/or the sub-unit 52 of FIG. 1*b* are explained with reference to FIG. 2. In a corresponding manner, the pull rod 14 of the processing unit 1 and/or the sub-unit 2 of FIG. 1*a* is preloaded by means of the tensioning device 23.

In a state in which the pull rod 14 of the adjusting device 5 is not, or is only slightly under tensile load along the working axis 8, the external thread 20 of the tool support 4 of the sub-unit 52 of the processing unit 51 is screwed into an internal thread of a threaded bore 24 on a part of the tensioning device 23 provided as a support 25 of the device. As a result, the tool support 4 is effectively supported on the support 25 of the device in the backward stroke direction 10. The clamping nut 15 seated on the pull rod 14 contacts the backward stroke bearing surface 13 of the tool support 4 without force, or under the effect of the slight preload of the pull rod 14.

In addition, the pull rod 14 of the sub-unit 52 is screwed into a threaded hole 26 on a tension member 27 of the tensioning device 23 via a portion of the pull rod external thread 19 provided as a coupling thread 19*b*, and is thereby connected to the tension member 27.

When the tool support 4 is supported on the support 25 of the device in the backward stroke direction 10, the tension member 27 of the tensioning device 23 connected to the pull rod 14 of the sub-unit 52 is then loaded in a tensioning direction illustrated in FIG. 2 by an arrow 28, which coincides with the backward stroke direction 10, and, due to the loading of the tension member 27 in the tensioning direction 28, the pull rod 14 supported on the tool support 4 at the opposite end via the machine tool 3 is subjected to tensile load in the backward stroke direction 10 of the processing unit 51 and/or sub-unit 52.

Due to the tensile load on the pull rod 14, the adjusting nut 15 of the clamping device 5 lifts off the backward stroke bearing surface 13 of the tool support 4, and the adjusting nut 15 can be moved into a previously defined target position on the pull rod 14 along the working axis 8 by rotating it about the working axis 8. This occurs without friction between the adjusting nut 15 and the backward stroke bearing surface 13 of the tool support 4 during the rotary actuation of the adjusting nut 15, which would make the rotary actuation of the adjusting nut 15 more difficult and which could impair the accuracy of the adjustment of the adjusting nut 15.

As soon as the adjusting nut 15 is advanced into the target position on the pull rod 14, the pull rod 14 is separated from the tension member 27 of the tensioning device 23. After the pull rod 14 has been separated from the tension member 27 of the tensioning device 23, as a result of the effect of the preload of the pull rod 14, the adjusting nut 15 acts on the backward stroke bearing surface 13 of the tool support 4, and the machine tool 3 acts on the forward stroke bearing surface 11 of the tool support 4.

The target position of the adjusting nut 15 on the pull rod 14 is defined in such a way that after the pull rod 14 has been separated from the tension member 27 of the tensioning device 23, a preload of the pull rod 14 is adjusted, and is of such a magnitude that during the backward stroke of the processing unit 51 executed as part of the processing of the workpiece 7, on the one hand, a lifting of the machine tool 3 from the forward stroke bearing surface 11 on the support is effectively prevented and, on the other hand, the resulting tensile load on the pull rod 14, which is the sum of the tensile load of the pull rod 14 caused by the backward stroke of the processing unit 51 and the previously adjusted preload of the pull rod 14, does not exceed the material-specific tensile strength of the pull rod 14.

In order to be able to make maximum use of the tensile strength of the pull rod 14, the tension member 27 of the tensioning device 23 is loaded hydraulically in the tensioning direction 28 in order to preload the pull rod 14. The hydraulic tensile load on the pull rod 14 enables the preload of the pull rod 14 to be adjusted to an exact amount. As a result, the preload of the pull rod 14 can be set to a maximum value in a functionally reliable manner, which does not lead to a breakage of the pull rod 14 even with the addition of the tensile load on the pull rod 14 caused by the processing procedure.

The sub-unit 52 with the tension rod 14 preloaded in the above manner is unscrewed from the support 25 of the tensioning device 23, and thereby separated from the tensioning device 23.

Subsequently, the sub-unit 52 is joined with an adapter provided as a coupling element so as to form the processing unit 51.

According to FIG. 3, a corresponding procedure is used in the manufacture of the processing unit 1. In the sub-unit 2, the pull rod 14 is first preloaded in the manner described above. Subsequently, the sub-unit 2 is connected with a coupling element designed as an adapter 29 so as to form the processing unit 1.

By means of the adapter 29, the processing unit 1 is fixed in a tool holder 30, indicated by dashed lines in FIG. 3, of a processing drive 34 of a processing machine designed as an axial forming machine 31. With the aid of the processing drive 34 of the axial forming machine 31, the forward stroke and the backward stroke of the processing unit 1 with respect to the workpiece 7 being processed are generated.

To connect the sub-unit 2 to the adapter 29, the tool support 4 and the adapter 29 are screwed together.

For this purpose, the threaded projection 21 of the tool support 4, which is provided with the external thread 20, is screwed in the manner of a screw bolt into an internal thread on the wall of a bolt receptacle 32 provided on the adapter 29. The protrusion of the tool support 4, protruding transverse to the working axis 8 of the processing unit 1 relative to the threaded projection 21, contacts a stop face 33 on the coupling element and/or on the adapter via its stop face 22 on the support, like a screw head.

Tightening the tool support 4 with a rotational movement of the tool support 4, supported in the axial direction on the adapter 29, relative to the adapter 29 leads to an elongation of the threaded projection 21 on the support screwed into the bolt receptacle 32 of the adapter 29. Since the support-side threaded projection 21 forms the backward stroke bearing surface 13 on the support for the adjusting nut 15 of the clamping device 5 on the end face pointing in the backward stroke direction 10, the elongation of the threaded projection 21 on the support causes via the adjusting nut 15 supported on the end face of the threaded projection 21 a slight tensile load and a preload of the pull rod 14 beyond the previously generated preload. This additional preload of the pull rod 14, caused by the assembly, must be taken into account when the preload of the pull rod 14 generated by the tensioning device 23 is set.

What is claimed is:

1. A processing unit for processing a workpiece wall of a workpiece (7), with relative movement of the workpiece (7) and the processing unit along a working axis (8) of the processing unit, with a forward stroke carried out by the processing unit in a forward stroke direction (9) of the processing unit towards the workpiece (7), and with a backward stroke carried out by the processing unit in a backward stroke direction (10) of the processing unit away from the workpiece (7), the processing unit comprising:

a machine tool (3) for processing the workpiece wall, wherein the machine tool (3) is in contact with the workpiece (7) during the forward stroke and during the backward stroke of the processing unit, a tool support (4) which is provided for the machine tool (3), and which has a forward stroke bearing surface (11) pointing in the forward stroke direction (9), and a backward stroke bearing surface (13) which is spaced apart on the tool support (4) from the forward stroke bearing surface (11) of the tool support (4) in the backward stroke direction along the working axis (8) of the processing unit and which faces away from the forward stroke bearing surface (11) of the tool support (4) and points in the backward stroke direction (10), wherein the machine tool (3) is arranged in front of the forward stroke bearing surface (11) of the tool support in the forward stroke direction (9) and lies opposite the forward stroke bearing surface (11) of the tool support (4) along the working axis (8), wherein the machine tool (3) is supported on the forward stroke bearing surface (11) of the tool support (4) in the opposite direction of the forward stroke direction (9) during the forward stroke of the processing unit, and wherein the tool support (4) has a threaded bolt (21) on the end of the tool support (4) positioned in the backward stroke direction (10) which threaded bolt (21) is provided with an external thread (20) and protrudes along the working axis (8), a clamping device (5) configured for clamping the machine tool (3) along the working axis (8) against the forward stroke bearing surface (11) of the tool support (4) and against the backward stroke bearing surface (13) of the tool support (4), wherein the clamping device (5) comprises a tension element (14) which is structurally separate from the tool support (4), which extends along the working axis (8), and which is connected along the working axis (8) to the machine tool (3) on one end, and on the other end has an adjusting thread (19*a*) with which an adjusting element (15) of the clamping device (5) is in threaded engagement, wherein, the adjusting element (15) of the clamping device (5) is opposite, along the working axis (8), the backward stroke bearing surface (13) of the tool support (4) facing away from the forward stroke bearing surface (11) of the tool support (4), wherein the machine tool (3) is supported on the backward stroke bearing surface (13) of the tool support (4) in the opposite direction of the backward stroke direction (10) during the backward stroke of the processing unit via the tension element (14) and the adjusting element (15), wherein the tension element (14) of the clamping device (5) can be subjected to tensile preload along the working axis (8), by means of a tensioning device (23) that comprises a tension member (27) and a support (25) having a threaded bore (24) with an internal thread, wherein the tension element (14) of the clamping device (5) can be subjected to tensile preload along the working axis (8), by loading the tension member (27) of the tensioning device (23) which tension member (27) is coupled to the tension element (14) of the clamping device (5) in the backward stroke direction (10) by means of a coupling device while the tool support (4) is supported on the support (25) of the tensioning device (23) in the backward stroke direction (10) by the internal thread of the threaded bore (24) of the support (25) of the tensioning device (23) being in threaded engagement with the external thread (20) of the threaded bolt (21) of the tool support (4), by moving the adjusting element (15) into a target position on the tension element (14) along the working axis (8) by rotary actuation while the tension member (27) of the tensioning device (23) is loaded in the backward stroke direction (10), and by cancelling the loading of the tension member (27) of the tensioning device (23) in the backward stroke direction (10) when the adjusting element (15) is arranged in the target position and thereby loading the backward stroke bearing surface (13) of the tool support (4), facing away from the forward stroke bearing surface (11) of the tool support (4), by the adjusting element (15) of the clamping device (5) along the working axis (8) in the direction of the machine tool (3), and wherein, when the tension element (14) of the clamping device (5) is preloaded along the working axis (8), the machine tool (3) is clamped along the working axis (8), against the forward stroke bearing surface (11) of the tool support (4) and against the backward stroke bearing surface (13) of the tool support (4), by means of the adjusting element (15) and the tension element (14) of the clamping device (5) subjected to tensile preload.

2. The processing unit according to claim 1, wherein a coupling thread (19*b*) is provided as the coupling device of the tension element (14) for producing a threaded connection to the tension member (27) of the tensioning device (23).

3. The processing unit according to claim 1, wherein the tension element (14) is designed as a pull rod.

4. The processing unit according to claim 1, wherein the tool support (4) is designed as a hollow body, and has a receptacle (16) for the tension element (14) extending along the working axis (8).

5. The processing unit according to claim 1, wherein the tension element (14) is connected to the machine tool (3) with a form fit.

6. The processing unit according to claim 1, wherein the adjusting element (15) of the clamping device (5) is designed as an adjusting nut, and has an outer contour adapted to an operating tool.

7. The processing unit according to claim 1, wherein the tool support (4) is limited in the backward stroke direction (10) by the backward stroke bearing surface (13) of the tool support (4).

8. The processing unit according to claim 1, wherein the processing unit comprises a coupling element (29) which is arranged on the side of the tool support (4) pointing in the backward stroke direction (10), and is connected, to the tool support (4), and wherein the coupling element (29) is designed to connect the processing unit to a processing drive (34) by means of which the relative movement of the workpiece (7) and the processing unit along the working axis (8) can be generated.

9. The processing unit according to claim 8, wherein the tool support (4) and the coupling element (29) are functionally connected to each other in a form-fitting manner along the working axis (8), wherein the tool support (4) has a stop surface (22) on a side facing the coupling element (29), extending transversely to the working axis (8), wherein the threaded bolt (21) is stepped back transverse to the working axis (8) relative to the stop surface (22) of the tool support (4), protrudes along the working axis (8) towards the coupling element (29), and forms, on an end face pointing in the backward stroke direction (10), the backward stroke bearing surface (13) of the tool support (4), wherein the coupling element (29), on a side facing the tool support (4), has a bolt receptacle (32) extending along the working axis (8), provided with an internal thread for the threaded bolt (21) of the tool support (4), and also a stop surface (33) of the coupling element (29) which stop surface (33) projects transverse to the working axis (8) relative to the bolt receptacle (32), and wherein the tool support (4) and the coupling element (29) are screwed together, with mutual loading of the tool support (4) and the coupling element (29) along the working axis (8) on the stop surface (22) of the tool support (4) and on the stop surface (33) of the coupling element (29).

10. A processing machine for processing a workpiece wall of a workpiece (7), having a processing unit (1) and having a processing drive (34) by means of which the workpiece (7) and the processing unit (1) can be moved relative to each other along a working axis (8) of the processing unit (1), with a forward stroke executed by the processing unit (1) in a forward stroke direction (9) of the processing unit (1) towards the workpiece (7), and with a backward stroke executed by the processing unit (1) in a backward stroke direction (10) of the processing unit (1) away from the workpiece (7), wherein the processing unit (1) is designed according to claim 1.

11. A method for producing a processing unit (1) according to claim 1, comprising:

functionally supporting the tool support (4) of the processing unit (1) on the support (25) of the tensioning device (23) in the backward stroke direction (10) by providing a threaded engagement between the external thread (20) of the threaded bolt (21) of the tool support (4) and the internal thread of the threaded bore (24) of the support (25) of the tensioning device (23), connecting the tension element (14) of the clamping device (5) to the tension member (27) of the tensioning device (23) on the side pointing in the backward stroke direction (10), subjecting the tension element (14) connected to the tension member (27) of the tensioning device (23) to tension in the backward stroke direction (10) by means of the tension member (27) of the tensioning device (23) loaded the backward stroke direction (10) when the tool support (4) is supported in the backward stroke direction (10) on the support (25) of the tensioning device (23) and when the tension element (14) is supported by the machine tool (3) on the forward stroke bearing surface (11) on of the tool support (4) in the backward stroke direction (10), moving the adjusting element (15) into a target position on the tension element (14) along the working axis (8) by rotary actuation when the tension element (14) is subjected to tension in the backward stroke direction (10) by means of the tension member (27) of the tensioning device (23), and cancelling the tensile load subjected to the tension element (14) by the tension member (27) of the tensioning device (23) when the adjusting element (15) is arranged in the target position, and thereby loading the backward stroke bearing surface (13) of the tool support (4) by the adjusting element (15) of the clamping device (5) along the working axis (8) in the direction of the machine tool (3), and clamping the machine tool (3) along the working axis (8) against the forward stroke bearing surface (11) of the tool support (4) and against the backward stroke bearing surface (13) of the tool support (4), by means of the adjusting element (15) and the tension element (14) of the clamping device (5) subjected to a tensile preload.

12. The method according to claim 11, wherein the tension member (27) of the tensioning device (23), by means of which the tension element (14) of the clamping device (5) is subjected to tension in the backward stroke direction (10), is hydraulically loaded in the backward stroke direction (10).

* * * * *